US008791865B2

(12) United States Patent
Su

(10) Patent No.: US 8,791,865 B2
(45) Date of Patent: Jul. 29, 2014

(54) MULTI-LOOP ANTENNA SYSTEM AND ELECTRONIC APPARATUS HAVING THE SAME

(75) Inventor: Saou-Wen Su, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 498 days.

(21) Appl. No.: 13/158,652

(22) Filed: Jun. 13, 2011

(65) Prior Publication Data

US 2012/0038519 A1 Feb. 16, 2012

(30) Foreign Application Priority Data

Aug. 13, 2010 (CN) ..... 2010 1 0255304

(51) Int. Cl.
*H01Q 1/24* (2006.01)

(52) U.S. Cl.
USPC ..... 343/702

(58) Field of Classification Search
USPC ..... 343/702, 866, 867
See application file for complete search history.

(56) References Cited

U.S. PATENT DOCUMENTS

| | | | | |
|---|---|---|---|---|
| 8,525,741 | B2 * | 9/2013 | Lee et al. | 343/702 |
| 2007/0046557 | A1 * | 3/2007 | Chen et al. | 343/795 |
| 2011/0102281 | A1 * | 5/2011 | Su | 343/742 |

FOREIGN PATENT DOCUMENTS

| | | | |
|---|---|---|---|
| TW | 357719 | M | 5/2009 |

* cited by examiner

*Primary Examiner* — Seung Lee
(74) *Attorney, Agent, or Firm* — Rosenberg, Klein & Lee

(57) ABSTRACT

A multi-loop antenna system includes a substrate having opposite first and second surfaces, a first loop antenna disposed on the first surface, and a second loop antenna disposed on one of the first and second surfaces. Each of the first and second loop antennas is operable in a corresponding one of first and second frequency bands, and includes a signal-feed portion and a grounding portion that are disposed adjacent to each other and that are disposed proximate to a respective one of peripheral edges of the substrate, and a radiator portion that has opposite ends connected electrically and respectively to the signal-feed and grounding portions and that cooperates therewith to form a loop.

23 Claims, 16 Drawing Sheets

MULTI-LOOP ANTENNA SYSTEM AND ELECTRONIC APPARATUS HAVING THE SAME

CROSS-REFERENCE TO RELATED APPLICATION

This application claims priority of Chinese Application No. 201010255304.4, filed on Aug. 13, 2010.

BACKGROUND OF THE INVENTION

1. Field of the Invention

The present invention relates to an antenna system and an electronic apparatus having the same, more particularly to a multi-loop antenna system and an electronic apparatus having the same.

2. Description of the Related Art

Generally, modern wireless network devices are compact and light-weight. Antennas that are installed in the wireless network devices include micro-strip antennas and patch antennas. Taiwanese Patent No. M357719 discloses a micro-strip array antenna having a signal-feed network for transmitting and receiving signals to and from each array radiator unit of the micro-strip array antenna, which has a half-wavelength resonant structure.

However, since dimensions of an array antenna are substantially determined by physical characteristics of half-wavelength resonance of the same, it is difficult to integrate a large number of array radiator units to form a portion of the array antenna, especially if the array antenna is a concurrent dual-band array antenna. Furthermore, feeding of signals to and from the array antenna is implemented by means of a probe pin such that circuit layout of a system module that is operatively associated with the array antenna needs to be adapted for disposing of the probe pin. Consequently, replacing the array antenna with a different array antenna requires that the system module be replaced with a different system module that is specifically adapted for use with the different array antenna.

SUMMARY OF THE INVENTION

Therefore, an object of the present invention is to provide a relatively small, low-profile multi-loop antenna system that exhibits high gain and high radiation directivity, and that is suitable for use in WLAN frequency bands.

Accordingly, a multi-loop antenna system of the present invention includes:

an antenna module including a substrate having first and second peripheral edges, and opposite first and second surfaces, a first loop antenna disposed on the first surface of the substrate, operable in a first frequency band, and including a first signal-feed portion and a first grounding portion that are disposed adjacent to each other and that are disposed proximate to the first peripheral edge of the substrate, and a first radiator portion that has opposite ends connected electrically and respectively to the first signal-feed portion and the first grounding portion and that cooperates therewith to form a loop, and a second loop antenna disposed on one of the first and second surfaces of the substrate, operable in a second frequency band, and including a second signal-feed portion and a second grounding portion that are disposed adjacent to each other and that are disposed proximate to the second peripheral edge of the substrate, and a second radiator portion that has opposite ends connected electrically and respectively to the second signal-feed portion and the second grounding portion and that cooperates therewith to form a loop.

Another object of the present invention is to provide an electronic apparatus with a multi-loop antenna system.

Accordingly, an electronic apparatus of the present invention includes:

a housing; and an antenna module disposed in the housing and including a substrate having first and second peripheral edges, and opposite first and second surfaces, a first loop antenna disposed on the first surface of the substrate, operable in a first frequency band, and including a first signal-feed portion and a first grounding portion that are disposed adjacent to each other and that are disposed proximate to the first peripheral edge of the substrate, and a first radiator portion that has opposite ends connected electrically and respectively to the first signal-feed portion and the first grounding portion and that cooperates therewith to form a loop, and a second loop antenna disposed on one of the first and second surfaces of the substrate, operable in a second frequency band, and including a second signal-feed portion and a second grounding portion that are disposed adjacent to each other and that are disposed proximate to the second peripheral edge of the substrate, and a second radiator portion that has opposite ends connected electrically and respectively to the second signal-feed portion and the second grounding portion and that cooperates therewith to form a loop.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
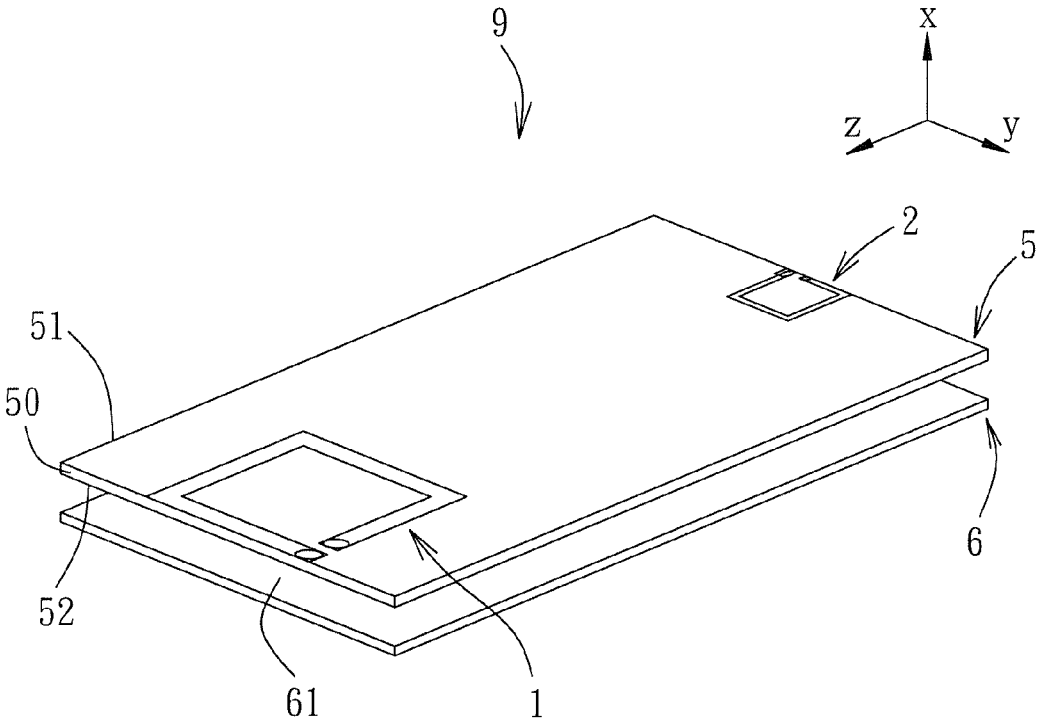
FIG. 1 is a perspective view of the first preferred embodiment of a multi-loop antenna system according to the present invention.

Before the present invention is described in greater detail, it should be noted that like elements are denoted by the same reference numerals throughout the disclosure.

Figure 2:
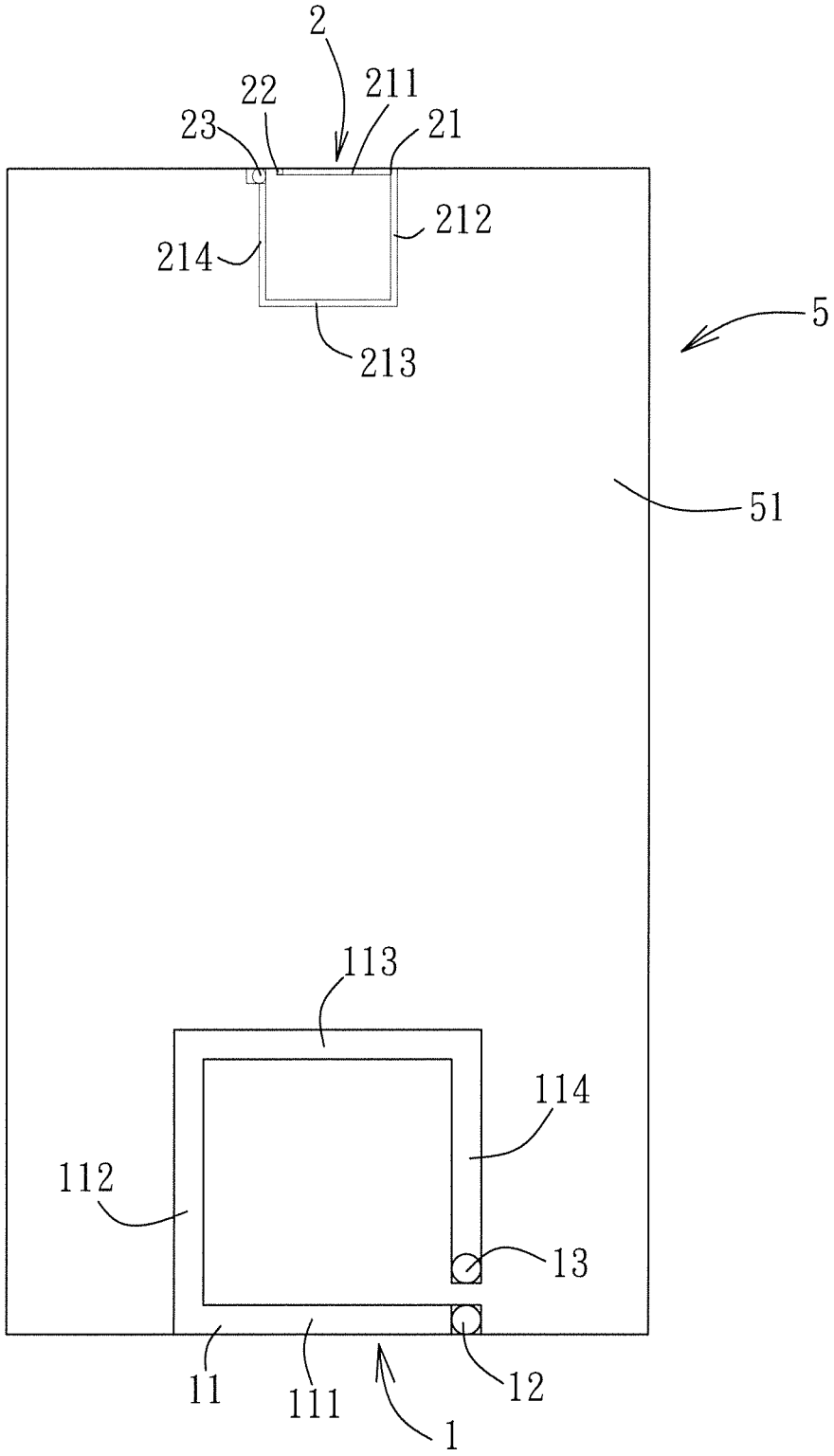
FIG. 2 is a schematic diagram of an antenna module of the multi-loop antenna system of the first preferred embodiment.

Referring to FIGS. 1 and 2, the first preferred embodiment of a multi-loop antenna system 9 according to the present invention is concurrently operable in a first frequency band ranging from 2400 MHz to 2484 MHz, and a second frequency band ranging from 5150 MHz to 5350 MHz, and includes an antenna module 5 and a system module 6. The antenna module 5 includes a substrate 50 that has opposite first and second surfaces 51, 52 and first and second peripheral edges, and first and second loop antennas 1, 2 that are respectively disposed at opposite sides of the substrate 50. The substrate 50 is preferably made of a dielectric material, such as glass fiber, FR4. The system module 6 has a grounding plane 61 spaced apart from, parallel to, facing toward, and stacked directly on the second surface 52 of the substrate 50. That is to say, the substrate 50 is stacked directly on the system module 6, and serves as a reflector for reflecting signals from the antenna module 5. It is to be noted that the second surface 52 and the grounding plane 61 are disposed on respective planes. In the first preferred embodiment, the first and second peripheral edges correspond to the opposite sides of the substrate 50, respectively.

The first loop antenna 1 is disposed on the first surface 51, is operable in the first frequency band, and includes a first grounding portion 12 and a first signal-feed portion 13 that are disposed adjacent to each other and that are disposed proximate to the first peripheral edge, and a first radiator portion 11 that has opposite ends connected electrically and respectively to the first grounding portion 12 and the first signal-feed portion 13 and that cooperates therewith to form a loop.

The second loop antenna 2 occupies an area smaller than that occupied by the first loop antenna 1, is disposed on the first surface 51, is operable in the second frequency band, and includes a second signal-feed portion 22 and a second grounding portion 23 that are disposed adjacent to each other and that are disposed proximate to the second peripheral edge, and a second radiator portion 21 that has opposite ends connected electrically and respectively to the second signal-feed portion 22 and the second grounding portion 23 and that cooperates therewith to form a loop. However, in other embodiments, the second loop antenna 2 may be disposed on the second surface 52.

In this embodiment, each of the first and second loop antennas 1, 2 is a rectangular one-wavelength loop antenna. However, in other embodiments, each of the first and second loop antennas 1, 2 may be such as a circular loop antenna.

The first and second loop antennas 1, 2 receive signals via respective signal transmission line (e.g., a coaxial cable) that are substantially identical in length such that signals radiated by the first and second loop antennas 1, 2 are substantially identical in amplitude and phase. Furthermore, the first and second loop antennas 1, 2 are operable to radiate signals simultaneously or independently, and may be disposed on the substrate 5 through Printed Circuit Board (PCB) techniques, which have advantages such as low costs and low spatial occupancy.

The first radiator portion 11 of the first loop antenna 1 includes: a first radiator segment 111 extending from the first grounding portion 12, and having a distal end distal from the first grounding portion 12; a second radiator segment 112 extending transversely from the distal end of the first radiator segment 111, and having a distal end distal from the first radiator segment 111; a third radiator segment 113 extending transversely from the distal end of the second radiator segment 112, and having a distal end distal from the second radiator segment 112; and a fourth radiator segment 114 extending transversely from the distal end of the third radiator segment 113 to connect electrically to the first signal-feed portion 13. The radiator segments 111-114, the first grounding portion 12 and the first signal-feed portion 13 cooperate to form the first loop antenna 1.

The second radiator portion 21 of the second loop antenna 2 includes: a fifth radiator segment 211 extending from the second signal-feed portion 22, and having a distal end distal from the second signal-feed portion 22; a sixth radiator segment 212 extending transversely from the distal end of the fifth radiator segment 211, and having a distal end distal from the fifth radiator segment 211; a seventh radiator segment 213 extending transversely from the distal end of the sixth radiator segment 212, and having a distal end distal from the sixth radiator segment 212; and an eighth radiator segment 214 extending transversely from the distal end of the seventh radiator segment 213 to connect electrically to the second grounding portion 23. The radiator segments 211-214, the second signal-feed portion 22 and the second grounding portion 23 cooperate to form the second loop antenna 2.

It is to be noted that the first radiator segment 111 of the first loop antenna 1 is disposed proximate to the first peripheral edge relative to the second, third, and fourth radiator segments 112-114, and that the fifth radiator segment 211 of the second loop antenna 2 is disposed proximate to the second peripheral edge relative to the sixth, seventh, and eighth radiator segments 212-214.

Figure 3:
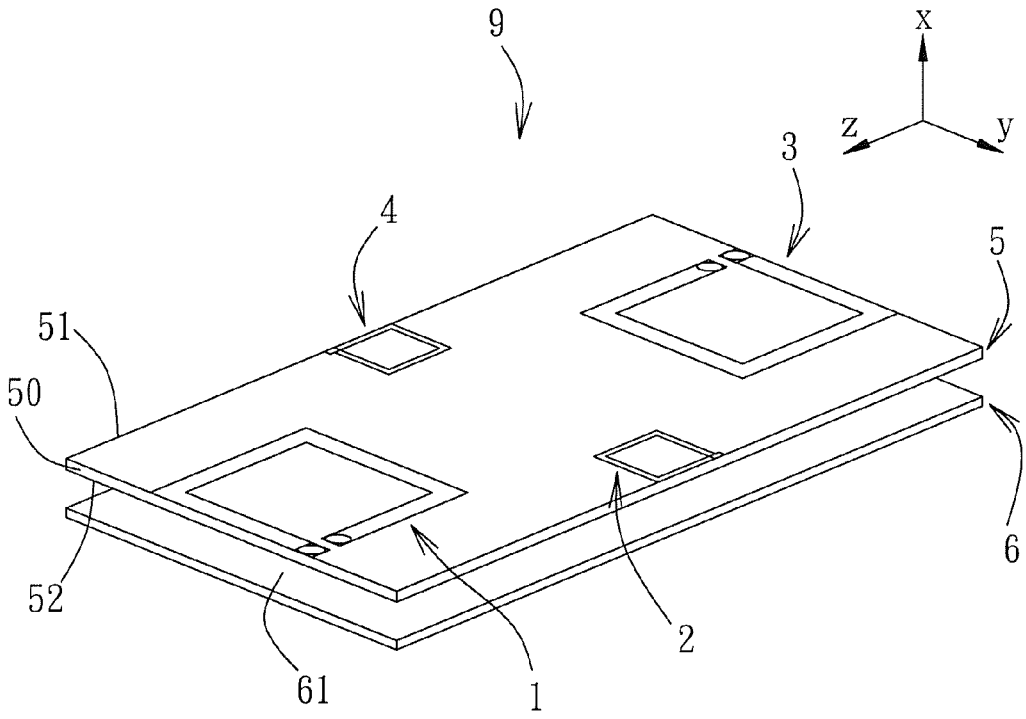
FIG. 3 is a perspective view of the second preferred embodiment of a multi-loop antenna system according to the present invention.
Figure 4:
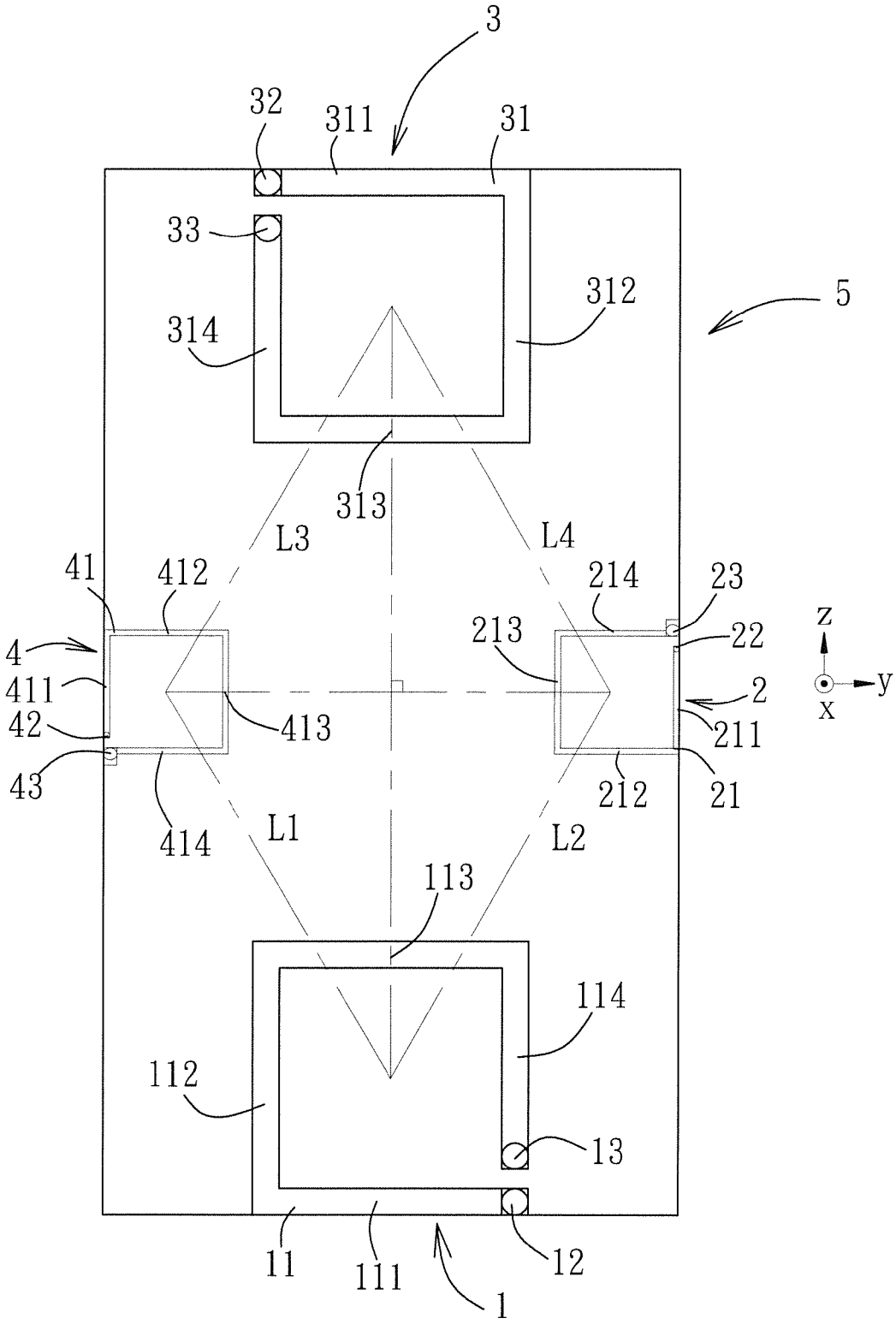
FIG. 4 is a schematic diagram of an antenna module of the multi-loop antenna system of the second preferred embodiment.

Referring to FIGS. 3 and 4, in the second preferred embodiment, the antenna module 5 further includes third and fourth loop antennas 3, 4, and the substrate 50 is a rectangular substrate having opposite first and third sides and opposite second and fourth sides. The first and third loop antennas 1, 3 are disposed respectively at opposite first and third sides of the substrate 50, and the second and fourth loop antennas 2, 4 are respectively disposed at opposite second and fourth sides of the substrate 50. In this embodiment, the first and second peripheral edges correspond to the first and second sides, respectively, and the substrate 50 further has third and fourth peripheral edges corresponding to the third and fourth sides, respectively. It is to be noted that configuration of the substrate 50 is not limited to such.

The third loop antenna 3 is substantially identical to the first loop antenna 1, is disposed on the first surface 51, is operable in the first frequency band, and includes a third grounding portion 32 and a third signal-feed portion 33 that are disposed adjacent to each other and that are disposed proximate to the third peripheral edge, and a third radiator portion 31 that has opposite ends connected electrically and respectively to the third grounding portion 32 and the third signal-feed portion 33 and that cooperates therewith to form a loop.

The third radiator portion 31 of the third loop antenna 3 includes: a ninth radiator segment 311 extending from the third grounding portion 32, and having a distal end distal from the third grounding portion 32; a tenth radiator segment 312 extending transversely from the distal end of the ninth radiator segment 311, and having a distal end distal from the ninth radiator segment 311; an eleventh radiator segment 313 extending transversely from the distal end of the tenth radiator segment 312, and having a distal end distal from the tenth radiator segment 312; and a twelfth radiator segment 314 extending transversely from the distal end of the eleventh radiator segment 313 to connect electrically to the third signal-feed portion 33. The radiator segments 311-314, the third grounding portion 32 and the third signal-feed portion 33 cooperate to form the third loop antenna 3.

The fourth loop antenna 4 is substantially identical in the second loop antenna 2, is disposed on the first surface 51, is operable in the second frequency band, and includes a fourth signal-feed portion 42 and a fourth grounding portion 43 that are disposed adjacent to each other and that are disposed proximate to the fourth peripheral edge, and a fourth radiator portion 41 that has opposite ends connected electrically and respectively to the fourth signal-feed portion 42 and the fourth grounding portion 43 and that cooperates therewith to form a loop.

The fourth radiator portion 41 of the fourth loop antenna 4 includes: a thirteenth radiator segment 411 extending from the fourth signal-feed portion 42, and having a distal end distal from the fourth signal-feed portion 42; a fourteenth radiator segment 412 extending transversely from the distal end of the thirteenth radiator segment 411, and having a distal end distal from the thirteenth radiator segment 411; a fifteenth radiator segment 413 extending transversely from the distal end of the fourteenth radiator segment 412, and having a distal end distal from the fourteenth radiator segment 412; and a sixteenth radiator segment 414 extending transversely from the distal end of the fifteenth radiator segment 413 to connect electrically to the fourth grounding portion 43. The radiator segments 411-414, the fourth signal-feed portion 42 and the fourth grounding portion 43 cooperate to form the fourth loop antenna 4.

In the second preferred embodiment, the first and third loop antennas 1, 3 receive identical signals via respective signal transmission lines that are substantially identical in length such that signals radiated by the first and third loop antennas 1, 3 are substantially identical in amplitude and phase. The second and fourth loop antennas 2, 4 receive identical signals via respective signal transmission lines that are substantially identical in length such that signals radiated by the second and fourth loop antennas 2, 4 are substantially identical in amplitude and phase. Furthermore, the first, second, third, and fourth loop antennas 1, 2, 3, 4, which are disposed respectively at the first, second, third, and fourth sides, are operable to radiate signals simultaneously or independently, and may be disposed on the substrate 50 through PCB techniques, which have advantages such as low costs and low spatial occupancy.

It is worth noting that, the signal-feed portions 13, 22, 33, 42 and the grounding portions 12, 23, 32, 43 are disposed proximate to the corresponding peripheral edges of the substrate 50 so as to reduce interference among the transmission lines.

The multi-loop antenna system of the second preferred embodiment is further configured such that a first extending line extending between geometric centers of the first and third loop antennas 1, 3 is perpendicular to a second extending line extending between geometric centers of the second and fourth loop antennas 2, 4. Furthermore, the geometric centers of the first and third loop antennas 1, 3 are equidistant to an intersection of the first and second extending lines, and the geometric centers of the second and fourth loop antennas 2, 4 are equidistant to the intersection of the first and second extending lines. Therefore, the antenna module 5 has a symmetrical structure and hence a symmetrical radiation/communication coverage space. That is to say: Line L1, which extends between the geometric centers of the first and fourth loop antennas 1, 4, and Line L4, which extends between the geometric centers of the second and third loop antennas 2, 3, have the same length and are parallel to each other; and Line L2, which extends between the geometric centers of the first and second loop antennas 1, 2, and Line L3, which extends between the geometric centers of the third and fourth loop antennas 3, 4, have the same length and are parallel to each other.

Preferably, the first grounding portion 12 and the first signal-feed portion 13 of the first loop antenna 1 are diagonally opposite to the third grounding portion 32 and the third signal-feed portion 33 of the third loop antenna 3 with respect to the intersection of the first and second extending lines, and the second signal-feed portion 22 and the second grounding portion 23 of the second loop antenna 2 are diagonally opposite to the fourth signal-feed portion 42 and the fourth grounding portion 43 of the fourth loop antenna 4 with respect to the intersection of the first and second extending lines. Such an arrangement ensures that signals radiated by the first loop antenna 1 are out-of-phase relative to those radiated by the third loop antenna 3, and that signals radiated by the second loop antenna 2 are out-of-phase relative to those radiated by the fourth loop antenna 4, thereby optimizing isolation between the first and third loop antennas 1, 3 and between the second and fourth loop antennas 2, 4.

Figure 5:
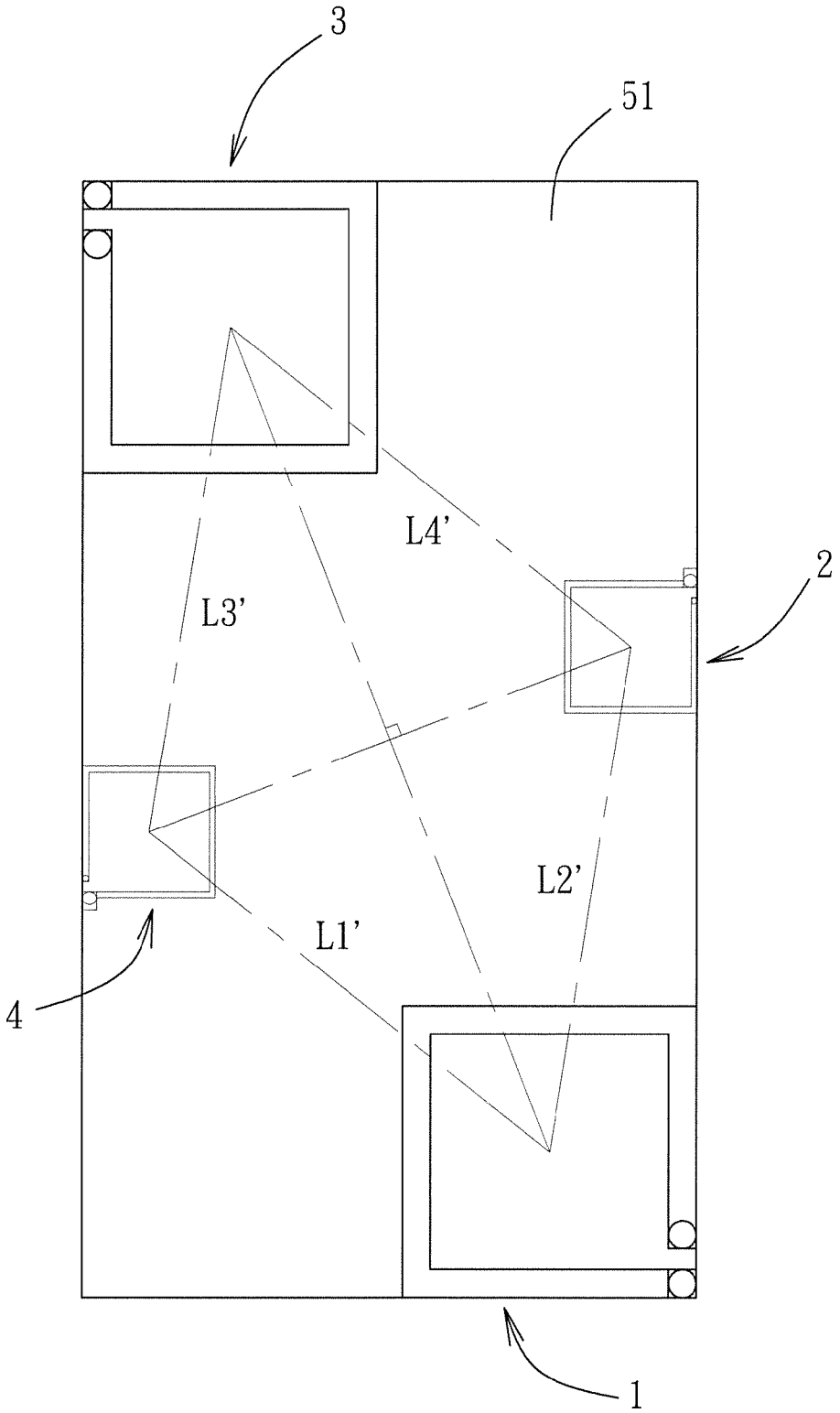
FIG. 5 is a schematic diagram of an antenna module of a modification of the multi-loop antenna system of the second preferred embodiment according to the present invention.
Figure 6:
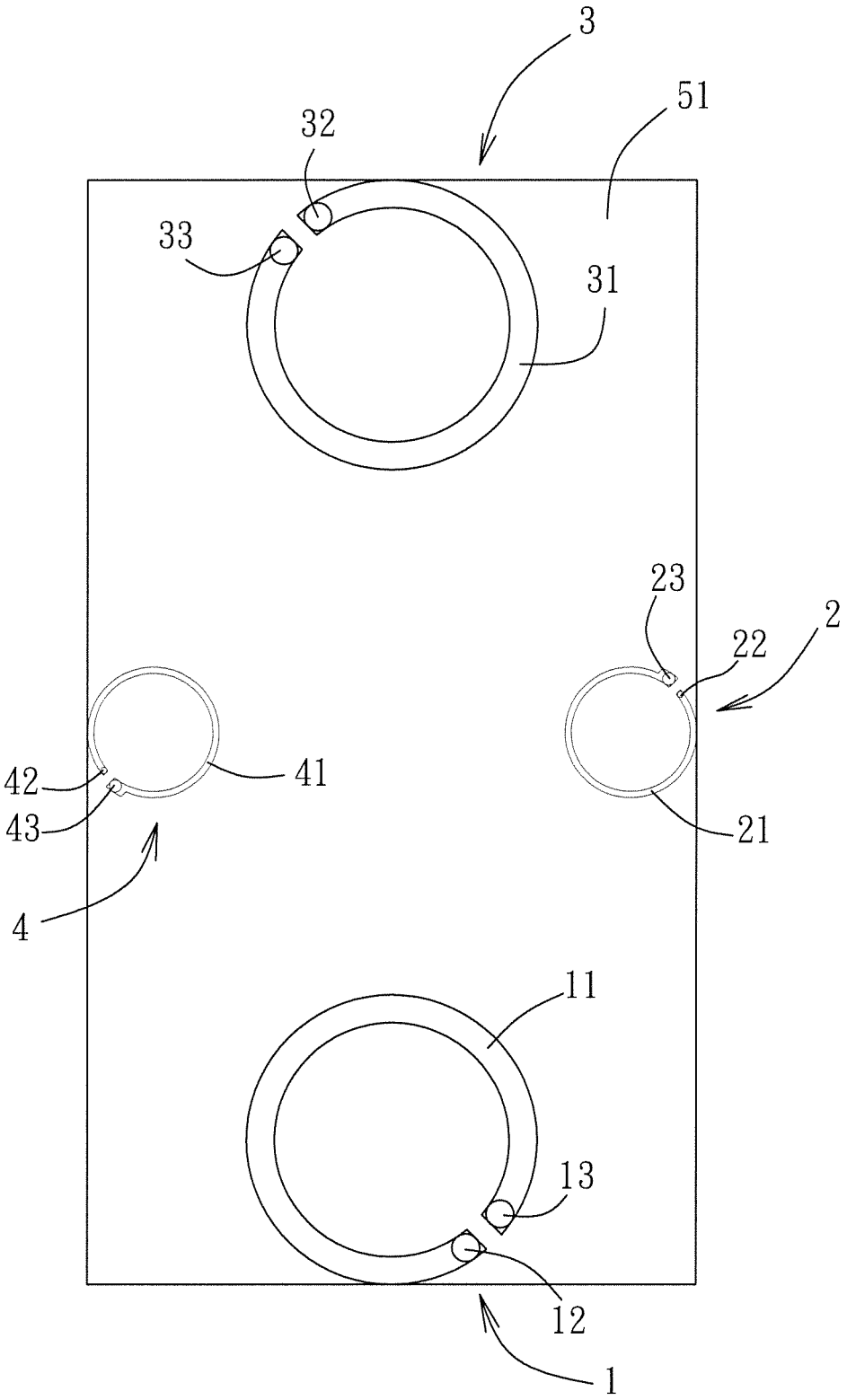
FIG. 6 is a schematic diagram of an antenna module of another modification of the multi-loop antenna system of the second preferred embodiment according to the present invention.

Referring to FIG. 5, in a modification, the first, second, third, and fourth loop antennas 1, 2, 3, 4 may be disposed otherwise, as long as the aforesaid geometric relationship between the first and second extending lines, and those between the geometric centers of the first, second, third, and fourth loop antennas 1, 2, 3, 4 relative to the intersection of the first and second extending lines, are satisfied. Specifically, the first and third loop antennas 1, 3 are operable in the first frequency band and are disposed symmetric about the geometric center, and the second and fourth loop antennas 2, 4 are operable in the second frequency band and are disposed symmetric about the geometric center. Moreover, referring to FIG. 6, in other embodiments, each of the first, second, third, and fourth loop antennas 1, 2, 3, 4 may be a circular loop antenna.

It is to be noted that the signal-feed portions 13, 22, 33, 42 and the grounding portions, 12, 23, 32, 43 are disposed at the respective sides of the substrate and disposed proximate to the corresponding peripheral edges so as to avoid overlapping of the loop antennas 1, 2, 3, 4 by the respective signal transmission lines, thereby reducing interference between the loop antennas 1, 2, 3, 4 and the respective signal transmission lines.

The system module 6 in the second preferred embodiment is identical to that in the first preferred embodiment, and serves as a reflector for reflecting signals from the antenna module 5. Signals radiated by the antenna module 5 thus have high directivity and high gain in a direction from the system module 6 to the antenna module 5. The system module 6 may be implemented such that it has a multilayer structure, of which the upmost layer may be a thin metallic layer, and remaining layers may form a dielectric substrate or may be circuit layers. In addition, since the antenna module 5 and the system module 6 are spaced apart from each other, electronic components of the system module 6 may be disposed therebetween. It is worth noting that the substrate 50 preferably occupies an area not larger than that occupied by the system module 6, which ensures substantial reflection of signals from the antenna module 5 by the system module 6.

Figure 7:
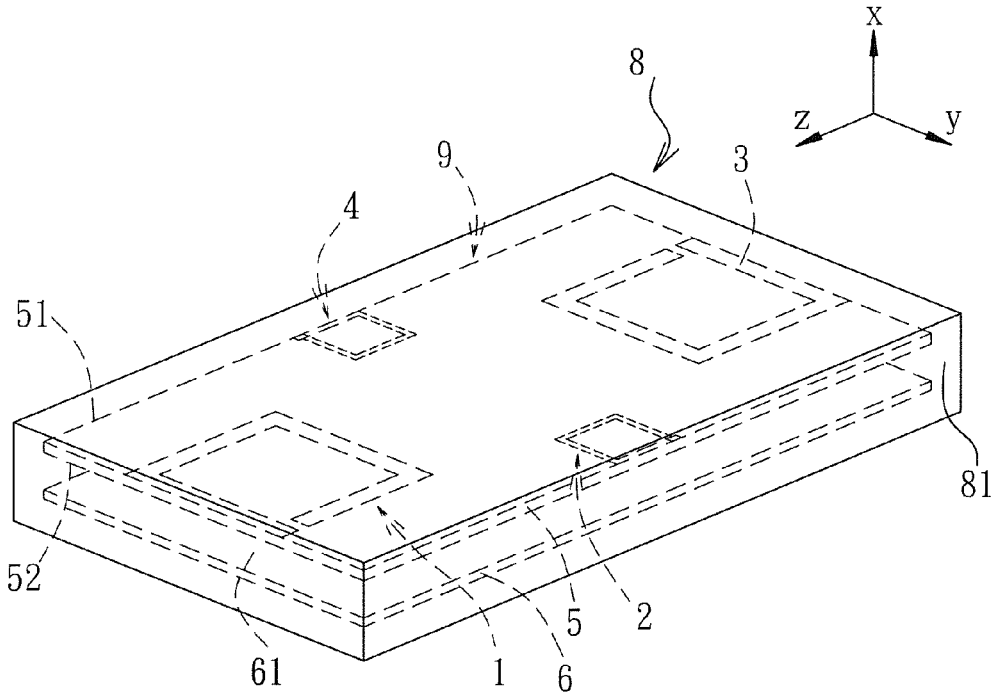
FIG. 7 is a perspective view of an electronic apparatus including the multi-loop antenna system of the second preferred embodiment.

Referring to FIG. 7, the multi-loop antenna system 9 may be installed in a housing 81 of an electronic apparatus 8, such as a wireless access point or a repeater, and signals are fed to the loop antennas 1, 2, 3, 4 via such as mini-coaxial cables (not shown). The multi-loop antenna system 9 may be implemented with different combinations of the antenna and system modules 5, 6 to meet design needs.

Figure 8:
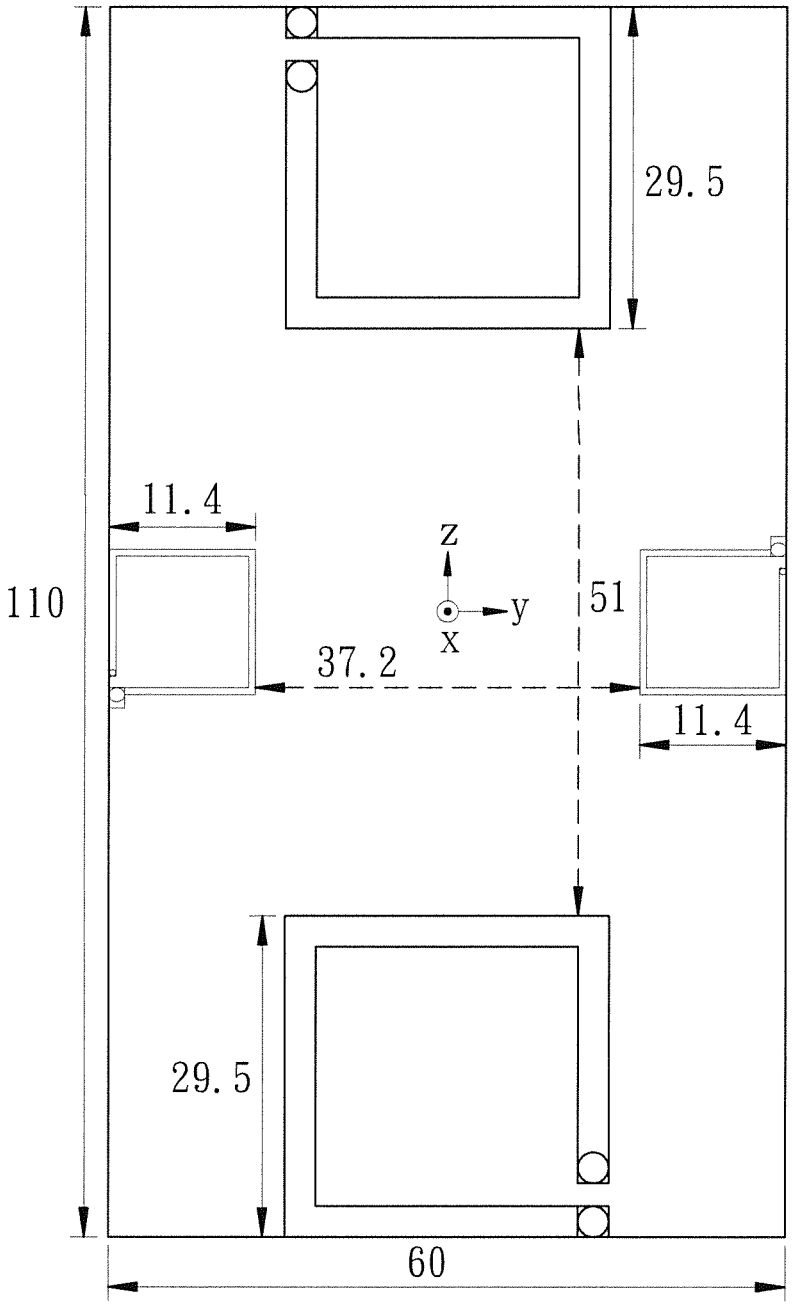
FIG. 8 is a schematic diagram illustrating dimensions of the antenna module of the multi-loop antenna system of the second preferred embodiment.
Figure 9:
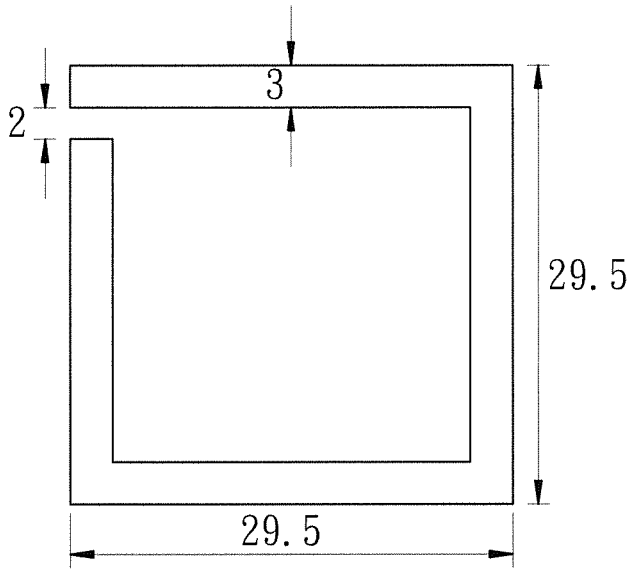
FIG. 9 is a schematic diagram illustrating dimensions of each of first and third loop antennas of the antenna module of the multi-loop antenna system of the second preferred embodiment.
Figure 10:
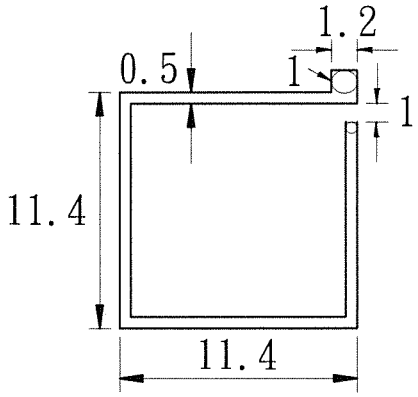
FIG. 10 is a schematic diagram illustrating dimensions of each of second and fourth loop antennas of the antenna module of the multi-loop antenna system of the second preferred embodiment.
Figure 11:
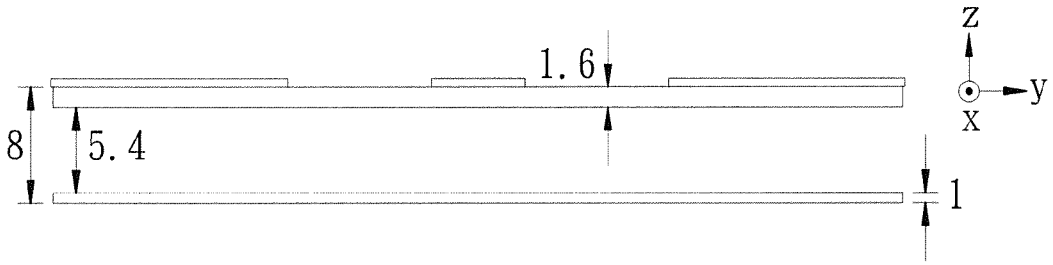
FIG. 11 is a schematic diagram of the multi-loop antenna system of the second preferred embodiment viewed from a different angle.

FIGS. 8 to 10 show dimensions of the antenna module 5, and those of the loop antennas 1, 2, 3, 4 thereof in millimeters (mm). However, configurations of the antenna module 5 and the loop antennas 1, 2, 3, 4 thereof are not limited to such. Each of the first and third loop antennas 1, 3 occupies an area four times larger than that occupied by each of the second and fourth loop antennas 2, 4. Referring to FIG. 11, the antenna and system modules 5, 6 are spaced apart from each other by a distance larger than 5 mm, and are preferably spaced apart by 5.4 mm for optimum antenna gain.

Figure 12:
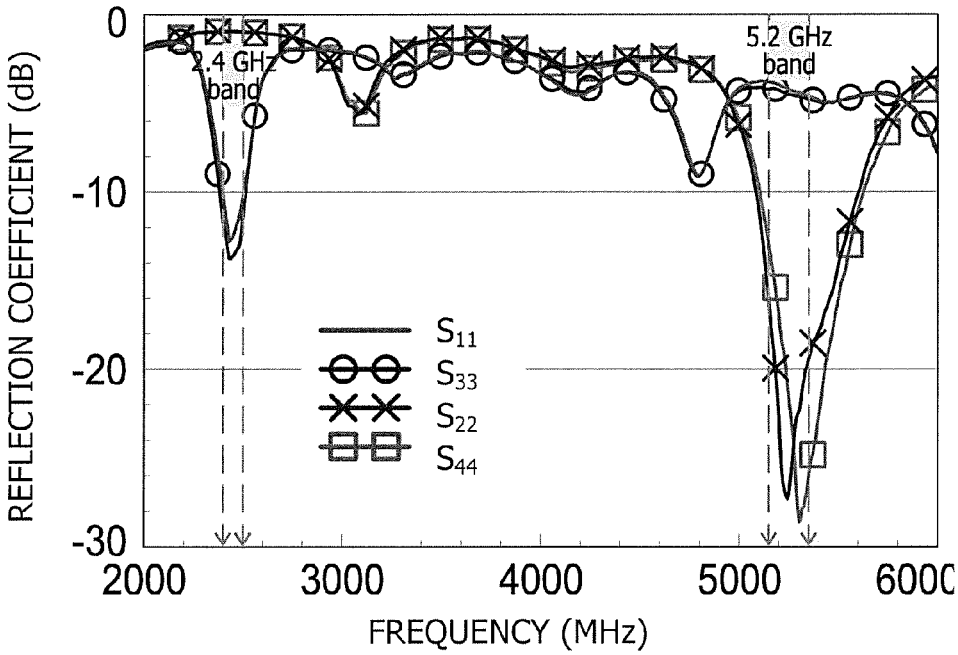
FIG. 12 is a plot of reflection coefficients of the multi-loop antenna system of the second preferred embodiment.
Figure 13:
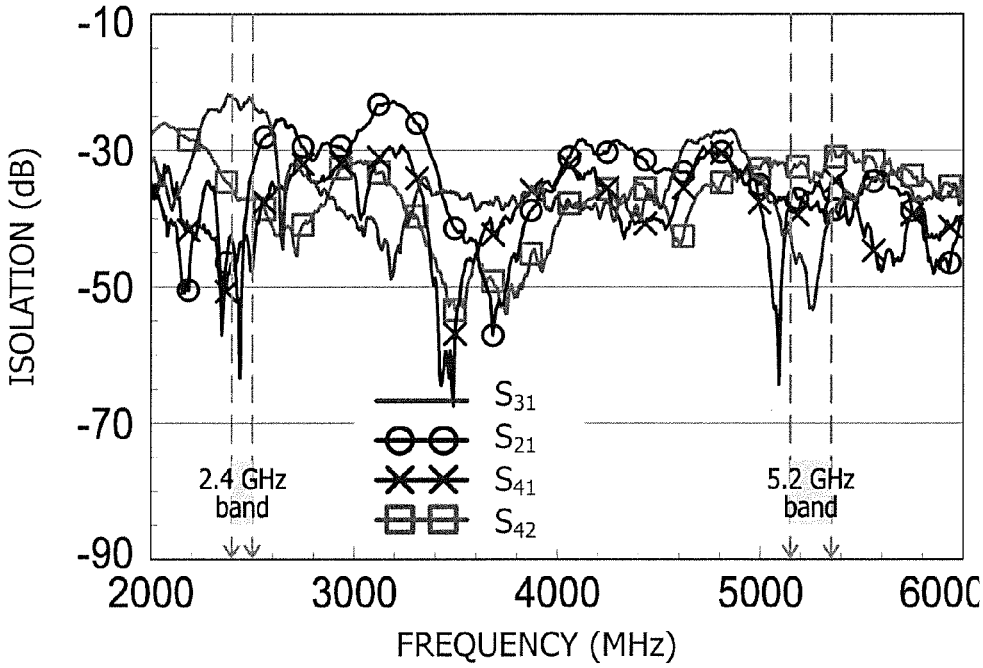
FIG. 13 is a plot of isolation of the multi-loop antenna system of the second preferred embodiment.

Referring to FIG. 12, $S_{11}$, $S_{22}$, $S_{33}$, and $S_{44}$ represent reflection coefficients of the first, second, third, and fourth loop antennas 1, 2, 3, 4, respectively. It is apparent that the multi-loop antenna system 9 of this embodiment has reflection coefficients lower than −10 dB in the first and second frequency bands. Referring to FIG. 13, $S_{31}$ represents isolation (in dB) between the first and third loop antennas 1, 3, $S_{21}$ represents that between the first and second loop antennas 1, 2, $S_{41}$ represents that between the first and fourth loop antennas 1, 4, and $S_{42}$ represents that between the second and fourth loop antennas 2, 4. It is apparent that values of isolations are substantially below −20 dB.

Figure 14:
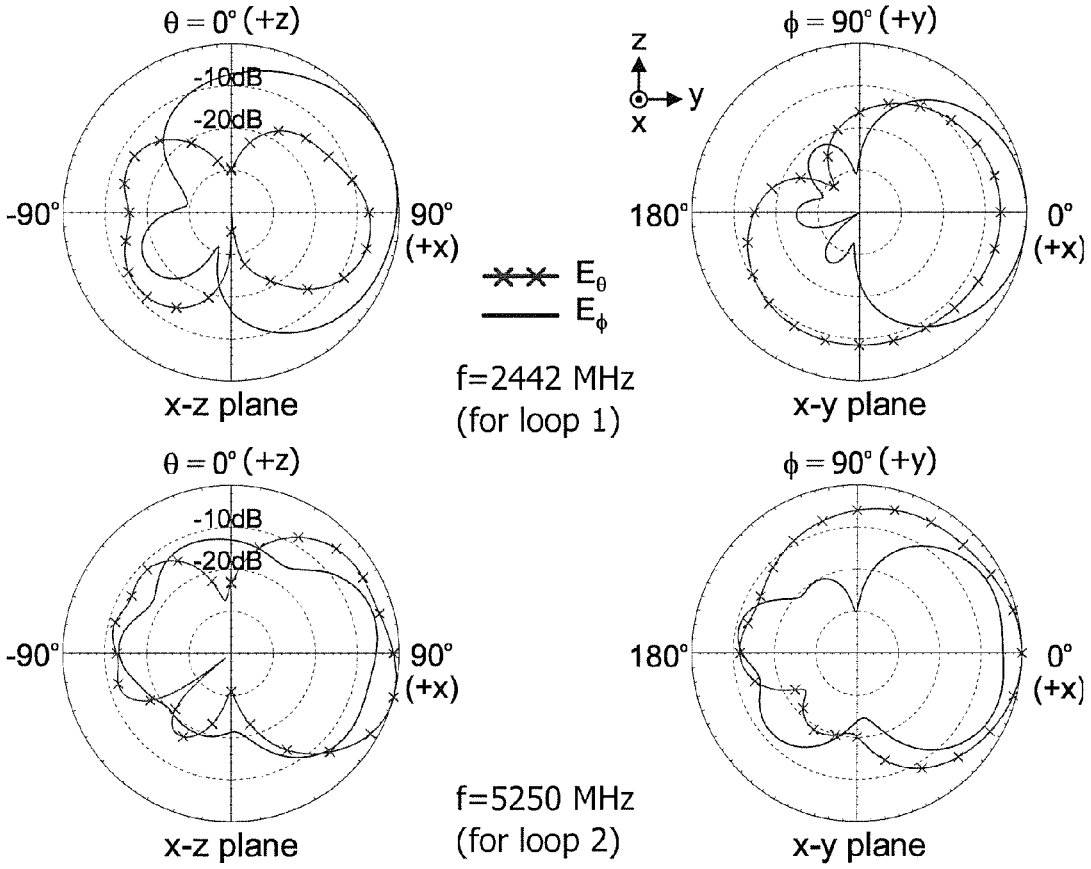
FIG. 14 shows two-dimensional radiation patterns of the first loop antenna in the second preferred embodiment at 2442 MHz, and those of the second loop antenna in the second preferred embodiment at 5250 MHz.
Figure 15:
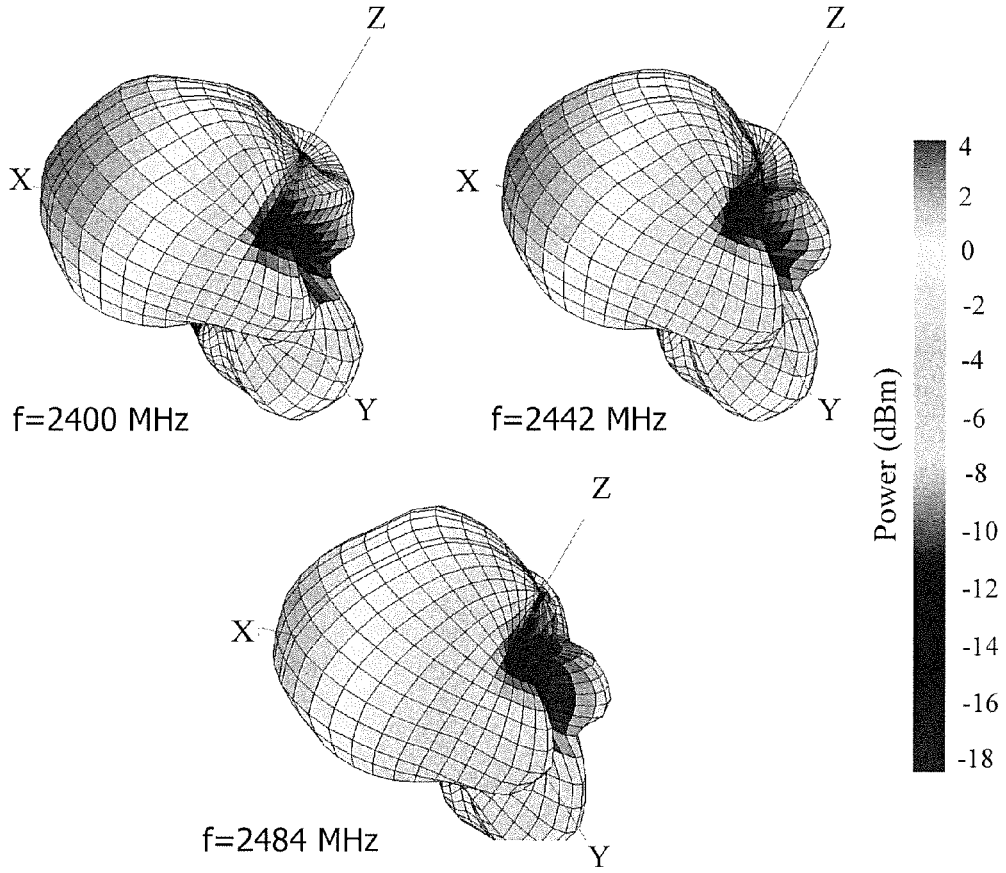
FIG. 15 shows three-dimensional radiation patterns of the multi-loop antenna system of the second preferred embodiment at 2400 MHz, 2442 MHz, and 2484 MHz, respectively.
Figure 16:
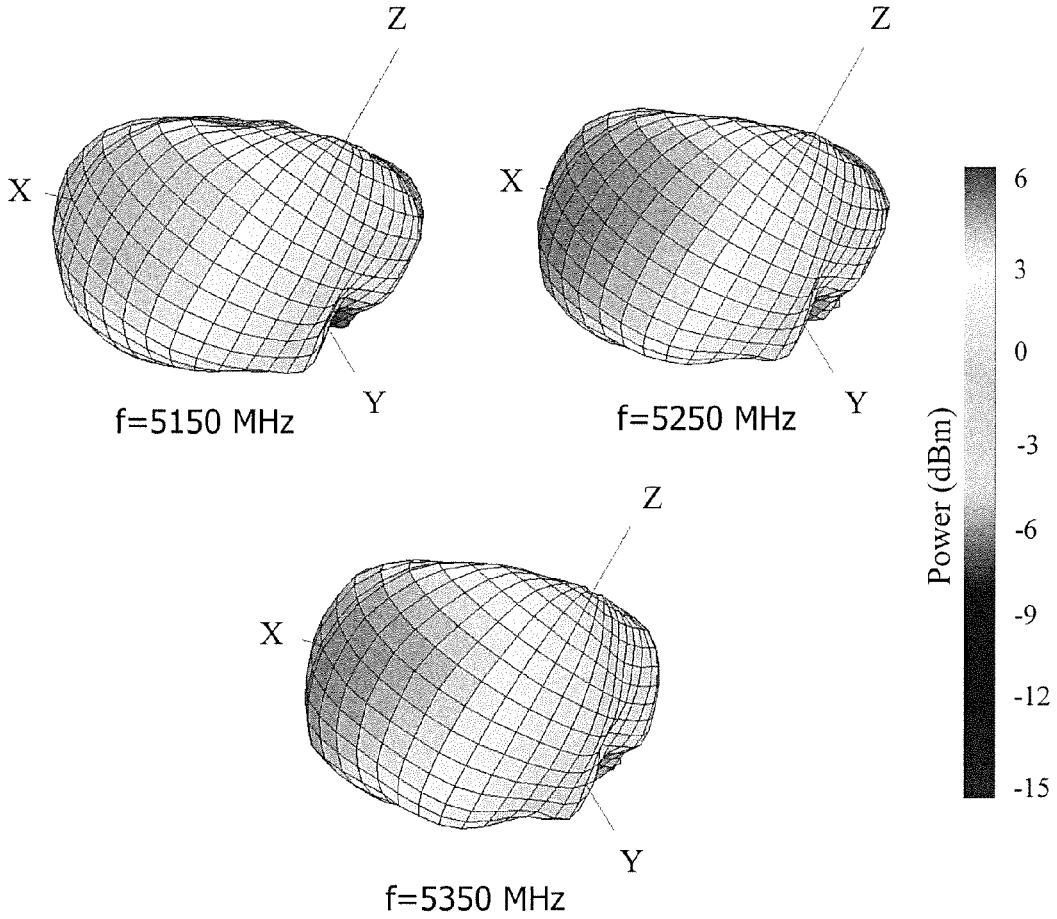
FIG. 16 shows three-dimensional radiation patterns of the multi-loop antenna system of the second preferred embodiment at 5150 MHz, 5250 MHz, and 5350 MHz, respectively.

FIG. 14 shows two-dimensional radiation patterns of the first and third loop antennas 1, 3 operating at 2442 MHz, and those of the second and fourth loop antennas 2, 4 operating at 5250 MHz. FIG. 15 shows three-dimensional radiation patterns of the multi-loop antenna system 9 operating at 2400 MHz, 2442 MHz, and 2484 MHz, respectively. FIG. 16 shows three-dimensional radiation patterns of the multi-loop antenna system 9 operating at 5150 MHz, 5250 MHz, and 5350 MHz, respectively. It is apparent from FIGS. 14 to 16 that the multi-loop antenna system 9 exhibits high-directivity, high-gain radiation patterns.

Figure 17:
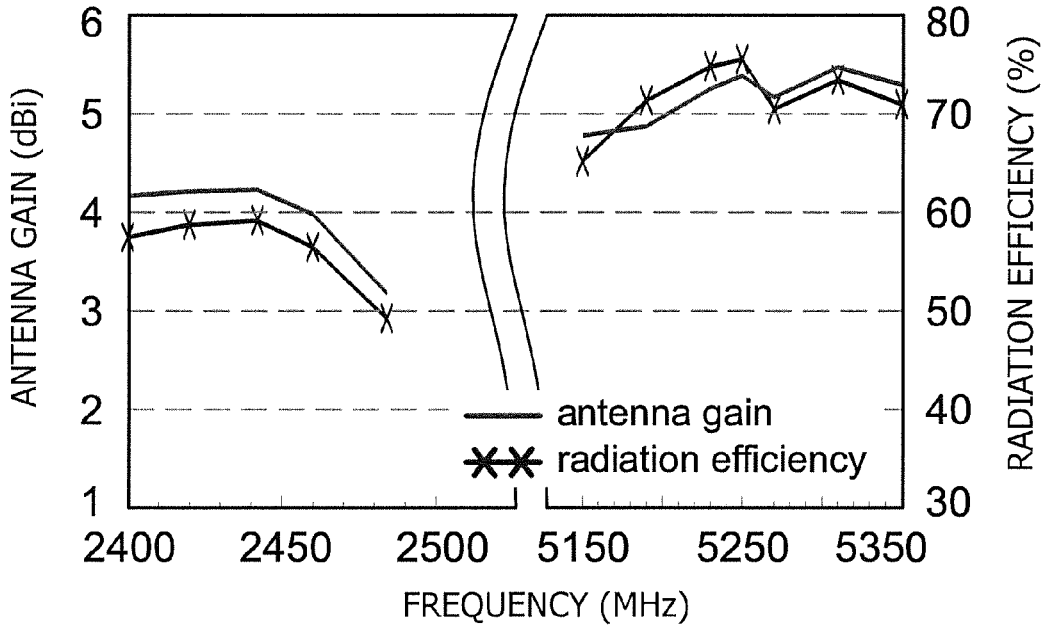
FIG. 17 is a plot of antenna gain and radiation efficiency of the multi-loop antenna system of the second preferred embodiment.

Referring to FIG. 17, the multi-loop antenna system 9 has maximum gains of 4 dBi and 5 dBi and radiation efficiencies of 50% and 70% in the first and second frequency bands, respectively.

Figure 18:
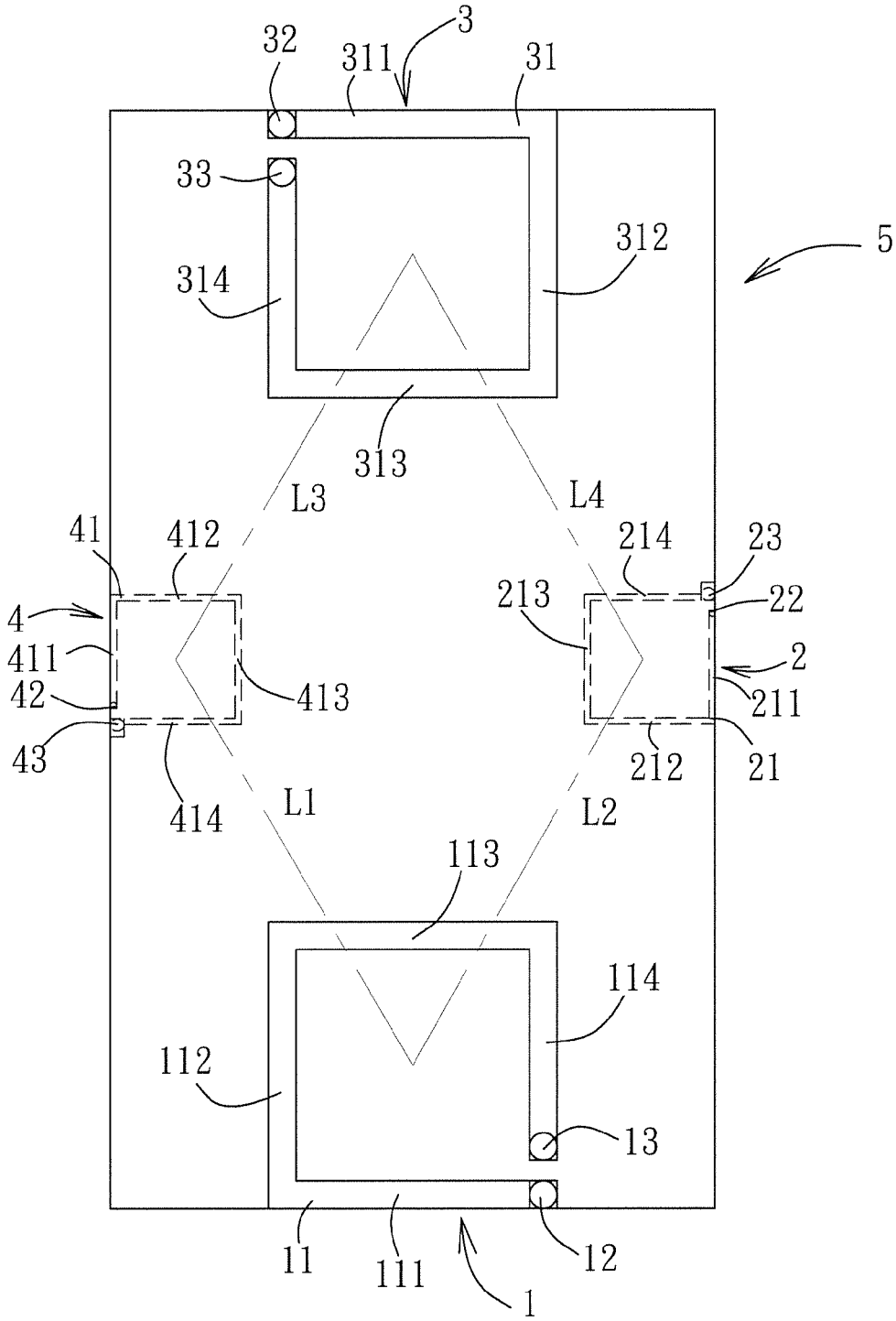
FIG. 18 is a schematic diagram of an antenna module of the third preferred embodiment of a multi-loop antenna system according to the present invention.

FIG. 18 shows the third preferred embodiment of a multi-loop antenna system 9 according to the present invention. The sole difference between the second and third preferred embodiments resides in that the second and fourth loop antennas 2, 4 of the third preferred embodiment are disposed on the second surface 52 instead of the first surface 51 of the substrate 50.

In summary, the loop antennas 1, 2, 3, 4 are operable to concurrently radiate signals. The symmetrical formation of the loop antennas 1, 2, 3, 4 ensures a symmetrical radiation/communication coverage space. Furthermore, the radiation patterns of the loop antennas 1, 2, 3, 4 are substantially identical. Moreover, the grounding plane 61 serves to reflect signals radiated by the loop antennas 1, 2, 3, 4 such that the radiated signals have high directivity in the direction from the system module 6 to the antenna module 5. This invention thus provides a multi-loop antenna system that is capable of concurrent operation in dual frequency bands, that has high directivity and gain, that is compact in size, and that has a low profile. Because PCB techniques are employed to fabricate the antenna module 5, fabrication is simple and low cost, and the antenna module 5 has a low-profile planar structure suitable for application to small outdoor wireless access points or repeaters.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A multi-loop antenna system comprising:

an antenna module including a substrate having first and second peripheral edges, and opposite first and second surfaces, a first loop antenna disposed on said first surface of said substrate, operable in a first frequency band, and including a first signal-feed portion and a first grounding portion that are disposed adjacent to each other and that are disposed proximate to said first peripheral edge of said substrate, and a first radiator portion that has opposite ends connected electrically and respectively to said first signal-feed portion and said first grounding portion and that cooperates therewith to form a loop, and a second loop antenna disposed on one of said first and second surfaces of said substrate, operable in a second frequency band, and including a second signal-feed portion and a second grounding portion that are disposed adjacent to each other and that are disposed proximate to said second peripheral edge of said substrate, and a second radiator portion that has opposite ends connected electrically and respectively to said second signal-feed portion and said second grounding portion and that cooperates therewith to form a loop.

2. The multi-loop antenna system as claimed in claim 1, wherein said first and second loop antennas are disposed at opposite sides of said substrate, respectively.

3. The multi-loop antenna system as claimed in claim 1, wherein said second loop antenna is disposed on said first surface of said substrate.

4. The multi-loop antenna system as claimed in claim 1, wherein each of said first and second loop antennas is a circular loop antenna.

5. The multi-loop antenna system as claimed in claim 1, wherein each of said first and second loop antennas is a rectangular loop antenna.

6. The multi-loop antenna system as claimed in claim 5, wherein said first radiator portion of said first loop antenna includes a first radiator segment extending from one of said first grounding portion and said first signal-feed portion, and having a distal end distal from said one of said first grounding portion and said first signal-feed portion, a second radiator segment extending transversely from said distal end of said first radiator segment, and having a distal end distal from said first radiator segment, a third radiator segment extending transversely from said distal end of said second radiator segment, and having a distal end distal from said second radiator segment, and a fourth radiator segment extending transversely from said distal end of said third radiator segment to connect electrically to the other one of said first grounding portion and said first signal-feed portion.

7. The multi-loop antenna system as claimed in claim 6, wherein said second radiator portion of said second loop antenna includes a fifth radiator segment extending from one of said second grounding portion and said second signal-feed portion, and having a distal end distal from said one of said second grounding portion and said second signal-feed portion, a sixth radiator segment extending transversely from said distal end of said fifth radiator segment, and having a distal end distal from said fifth radiator segment, a seventh radiator segment extending transversely from said distal end of said sixth radiator segment, and having a distal end distal from said sixth radiator segment, and an eighth radiator segment extending transversely from said distal end of said seventh radiator segment to connect electrically to the other one of said second grounding portion and said second signal-feed portion.

8. The multi-loop antenna system as claimed in claim 1, wherein said substrate further has third and fourth peripheral edges, and said antenna module further includes a third loop antenna disposed on said first surface of said substrate, operable in the first frequency band, and including a third signal-feed portion and a third grounding portion that are disposed adjacent to each other and that are disposed proximate to said third peripheral edge of said substrate, and a third radiator portion that has opposite ends connected electrically and respectively to said third signal-feed portion and said third grounding portion and that cooperates therewith to form a loop, and a fourth loop antenna disposed on said one of said first and second surfaces of said substrate, operable in the second frequency band, and including a fourth signal-feed portion and a fourth grounding portion that are disposed adjacent to each other and that are disposed proximate to said fourth peripheral edge of said substrate, and a fourth radiator portion that has opposite ends connected electrically and respectively to said fourth signal-feed portion and said fourth grounding portion and that cooperates therewith to form a loop.

9. The multi-loop antenna system as claimed in claim 8, wherein said substrate further has opposite first and third sides corresponding to said first and third peripheral edges, respectively, and opposite second and fourth sides corresponding to said second and fourth peripheral edges, respectively, said first, second, third, and fourth loop antennas being disposed at said first, second, third, and fourth sides, respectively.

10. The multi-loop antenna system as claimed in claim 9, wherein a first extending line extending between geometric centers of said first and third loop antennas is perpendicular to a second extending line extending between geometric centers of said second and fourth loop antennas.

11. The multi-loop antenna system as claimed in claim 10, wherein said geometric centers of said first and third loop antennas are equidistant to an intersection of said first and second extending lines, and said geometric centers of said second and fourth loop antennas are equidistant to the intersection of said first and second extending lines.

12. The multi-loop antenna system as claimed in claim 1, further comprising a system module that has a grounding plane spaced apart from, facing toward, and stacked on said second surface of said substrate, and that serves as a reflector for reflecting signals from said antenna module.

13. The multi-loop antenna system as claimed in claim 12, wherein said substrate of said antenna module occupies an area not larger than that occupied by said system module.

14. The multi-loop antenna system as claimed in claim 12, wherein said second surface of said substrate and said grounding plane of said system module are disposed on respective planes.

15. The multi-loop antenna system as claimed in claim 1, wherein said first loop antenna occupies an area four times larger than that occupied by said second loop antenna.

16. An electronic apparatus comprising:

a housing; and an antenna module disposed in said housing and including a substrate having first and second peripheral edges, and opposite first and second surfaces, a first loop antenna disposed on said first surface of said substrate, operable in a first frequency band, and including a first signal-feed portion and a first grounding portion that are disposed adjacent to each other and that are disposed proximate to said first peripheral edge of said substrate, and a first radiator portion that has opposite ends connected electrically and respectively to said first signal-feed portion and said first grounding portion and that cooperates therewith to form a loop, and a second loop antenna disposed on one of said first and second surfaces of said substrate, operable in a second frequency band, and including a second signal-feed portion and a second grounding portion that are disposed adjacent to each other and that are disposed proximate to said second peripheral edge of said substrate, and a second radiator portion that has opposite ends connected electrically and respectively to said second signal-feed portion and said second grounding portion and that cooperates therewith to form a loop.

17. The electronic apparatus as claimed in claim 16, wherein said first and second loop antennas are disposed at opposite sides of said substrate, respectively.

18. The electronic apparatus as claimed in claim 16, wherein said substrate further has third and fourth peripheral edges, and said antenna module further includes a third loop antenna disposed on said first surface of said substrate, operable in the first frequency band, and including a third signal-feed portion and a third grounding portion that are disposed adjacent to each other and that are disposed proximate to said third peripheral edge of said substrate, and a third radiator portion that has opposite ends connected electrically and respectively to said third signal-feed portion and said third grounding portion and that cooperates therewith to form a loop, and a fourth loop antenna disposed on said one of said first and second surfaces of said substrate, operable in the second frequency band, and including a fourth signal-feed portion and a fourth grounding portion that are disposed adjacent to each other and that are disposed proximate to said fourth edge of said substrate, and a fourth radiator portion that has opposite ends connected electrically and respectively to said fourth signal-feed portion and said fourth grounding portion and that cooperates therewith to form a loop.

19. The electronic apparatus as claimed in claim 18, wherein said substrate further has opposite first and third sides corresponding to said first and third peripheral edges, respectively, and opposite second and fourth sides corresponding to said second and fourth peripheral edges, respectively, said first, second, third, and fourth loop antennas being disposed at said first, second, third, and fourth sides, respectively.

20. The electronic apparatus as claimed in claim 16, further comprising a system module that is disposed in said housing, that has a grounding plane spaced apart from, facing toward, and stacked on said second surface of said substrate, and that serves as a reflector for reflecting signals from said antenna module.

21. The electronic apparatus as claimed in claim 20, wherein said substrate of said antenna module occupies an area not larger than that occupied by said system module.

22. The electronic apparatus as claimed in claim 20, further comprising electronic components disposed on said grounding plane of said system module.

23. The electronic apparatus as claimed in claim 16, wherein said second surface of said substrate and said grounding plane of said system module are disposed on respective planes.

* * * * *